US009941619B2

(12) United States Patent
Wada et al.

(10) Patent No.: US 9,941,619 B2
(45) Date of Patent: Apr. 10, 2018

(54) CONNECTOR

(71) Applicant: Yazaki Corporation, Minato-ku, Tokyo (JP)

(72) Inventors: Yoshimi Wada, Makinohara (JP); Abhishek Kumar Sinha, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/660,255

(22) Filed: Jul. 26, 2017

(65) Prior Publication Data

US 2018/0034188 A1 Feb. 1, 2018

(30) Foreign Application Priority Data

Jul. 29, 2016 (JP) ..... 2016-150734

(51) Int. Cl.

| | |
|---|---|
| ***H01R 13/40*** | (2006.01) |
| ***H01R 13/436*** | (2006.01) |
| ***H01R 13/422*** | (2006.01) |
| ***H01R 13/52*** | (2006.01) |
| *H01R 13/514* | (2006.01) |

(52) U.S. Cl.

CPC ..... *H01R 13/4368* (2013.01); *H01R 13/422* (2013.01); *H01R 13/4362* (2013.01); *H01R 13/4364* (2013.01); *H01R 13/5202* (2013.01); *H01R 13/514* (2013.01)

(58) Field of Classification Search

CPC ..... H01R 13/4223; H01R 13/4365; H01R 13/4364; H01R 13/4362; H01R 13/4361; H01R 13/4368

See application file for complete search history.

(56) References Cited

U.S. PATENT DOCUMENTS 4,946,398 A * 8/1990 Takenouchi ..... H01R 13/4368 439/595
5,061,210 A * 10/1991 Jinno ..... H01R 13/4368 439/595
5,256,083 A * 10/1993 Yamamoto ..... H01R 13/4364 439/595

(Continued)

FOREIGN PATENT DOCUMENTS

JP H09-251874 A 9/1997
JP 2002-056947 A 2/2002

(Continued)

*Primary Examiner* — Hien Vu

(74) *Attorney, Agent, or Firm* — Banner & Witcoff, Ltd.

(57) ABSTRACT

A connector includes a housing and a front holder. The front holder includes an arm portion to be exposed at a side surface of the housing. The housing includes a pair of extension walls on the side surface of the housing to cover the arm portion. The pair of extension walls has a first part and a second part. In the first part, a distance between the extension ends of the extension walls is constant. In the second part, the distance increases gradually as they extend away from the first part in the attaching direction. A distal end of the arm portion is in a position corresponding to the second part when the front holder is in a final lock position, and the distal end of the arm portion is in a position corresponding to the first part when the front holder is in a preliminary lock position.

2 Claims, 10 Drawing Sheets

(56) References Cited

U.S. PATENT DOCUMENTS

| | | | | | |
|---|---|---|---|---|---|
| 5,569,055 | A | * | 10/1996 | Yamanashi | H01R 13/4368 439/595 |
| 5,722,857 | A | | 3/1998 | Saito et al. | |
| 5,931,700 | A | | 8/1999 | Saito et al. | |
| 7,264,505 | B2 | | 9/2007 | Miyakawa | |
| 2007/0020997 | A1 | | 1/2007 | Miyakawa | |

FOREIGN PATENT DOCUMENTS

| | | | |
|---|---|---|---|
| JP | 3798233 | B2 | 7/2006 |
| JP | 2007-026943 | A | 2/2007 |
| JP | 2011-108576 | A | 6/2011 |

* cited by examiner

CONNECTOR

CROSS-REFERENCE TO RELATED APPLICATION

The present application claims priority from Japanese Patent Application No. 2016-150734 filed on Jul. 29, 2016, the entire content of which is incorporated herein by reference.

FIELD OF INVENTION

The present invention relates to a connector including a housing that has a terminal reception chamber in which a terminal can be received, and a front holder attached to the housing such that the front holder is moved toward a final lock position via a preliminary lock position, thereby double-locking the terminal in the terminal reception chamber.

RELATED ART

Related art connectors are provided with a mechanism for detecting whether a terminal has been properly received in a terminal reception chamber (more specifically, whether the terminal is in an incompletely inserted state) and for more reliably retaining the properly received terminal (see, e.g., JPH9-251874A, JP2007-026943A, JP3798233B2, and JP2011-108576A).

For example, one of the related art connectors includes a housing having a terminal reception chamber, and a front holder attached to the housing from the front side of the housing. In the related art connector, in a state in which the terminal has been properly received in the terminal reception chamber and in which the front holder has been attached at a final lock position, a double-locking portion of the front holder pushes a cantilever lance inside the housing toward a terminal. Thus, it is possible to obtain a double locking state where the lance locks the terminal and the double-locking portion of the front holder locks the lance. Due to this double locking, the terminal properly received in the terminal reception chamber can be reliably retained (see, e.g., JPH9-251874A).

The front holder of the related art connector has arm portions extending in the attaching direction of the front holder from its widthwise end portions. The arm portions are exposed at side surfaces of the housing when the front holder is attached to the housing (when the front holder is in the final lock position). With the related art connector, when removing the front holder to the housing, a user applies an external force to the arm portions (places fingers on the arm portions and pulls out) to move the arm portions along the attaching direction.

In the related art connector, the arm portions are left exposed at the side surfaces of the housing after the front holder is attached to the housing. Therefore, in a subsequent process (e.g., a step of fitting the related art connector to a counterpart connector), a hand of the user or a peripheral member may unintentionally touch the arm portions exposed at the side surfaces of the housing. Such touching may cause deformation or the like of the arm portions.

As means for preventing such deformation of the arm portions, for example, a measure can be taken so as not to expose the arm portions of the front holder to the outside by covering the entire arm portions with a cover or the like. According to this method, it is possible to prevent the arm portions from being touched from the outside, but on the other hand, the arm portions cannot be used when intentionally removing the front holder from the housing (when intentionally unlocking the double-lock), so that the work for removing the front holder from the housing may become troublesome.

SUMMARY

Illustrative aspects of the present invention provide a connector capable of achieving, as much as possible, both protection of arm portions that assist an attachment and the like of a front holder and easiness of an intentional unlocking of a double-lock by the front holder.

According to an illustrative aspect of the present invention, a connector includes a housing having a terminal reception chamber in which a terminal is received, and a front holder attached to the housing such that the front holder is moved toward a final lock position via a preliminary lock position to double-lock the terminal in the terminal reception chamber. The front holder includes an arm portion extending in an attaching direction of the front holder, at least a part of the arm portion being exposed at a side surface of the housing when the front holder is attached to the housing. The housing includes a pair of extension walls formed on the side surface of the housing and extending such that extension ends of the pair of extension walls approach each other to cover the arm portion. The pair of extension walls has a shape in which a first part and a second part are contiguous with each other, a distance between the extension ends of the extension walls being constant irrespective of a location in the attaching direction in the first part, the distance increases gradually in the second part as they extend away from the first part in the attaching direction. A distal end of the arm portion is in a position corresponding to the second part when the front holder is in the final lock position, and the distal end of the arm portion is in a position corresponding to the first part when the front holder is in the preliminary lock position.

Other aspects and advantages of the invention will be apparent from the following description, the drawings and the claims.

BRIEF DESCRIPTION OF THE DRAWINGS

FIGS. 2A and 2B illustrate a state in which a female-side front holder is attached to a female housing shown in FIG. 1, in which FIG. 2A illustrates a state in which the front holder is incompletely inserted (a state in which the front holder is in a "preliminary" lock position), and FIG. 2B illustrates a state in which the front holder is completely inserted (a state in which the front holder is in a "final" lock position);

FIGS. 4A and 4B are sectional views illustrating a state in which the female-side front holder is incompletely inserted into the female housing (that is, the state of FIG. 2A), in which FIG. 4A is a sectional view taken along the line A-A in FIG. 3, and FIG. 4B is a sectional view taken along the line B-B in FIG. 3;

FIGS. 5A and 5B are sectional views illustrating a state in which the female-side front holder is completely inserted into the female housing (that is, the state of FIG. 2B), in which FIG. 5A is a sectional view taken along the line A-A in FIG. 3, and FIG. 5B is a sectional view taken along the line B-B in FIG. 3;

DETAILED DESCRIPTION

Hereinafter, a connector according to an embodiment of the present invention will be described with reference to the drawings. In all the drawings which will be described below, terminals and electric wires extending from the terminals are omitted from illustration for the purpose of simplifying an explanation of each member.

Figure 1:
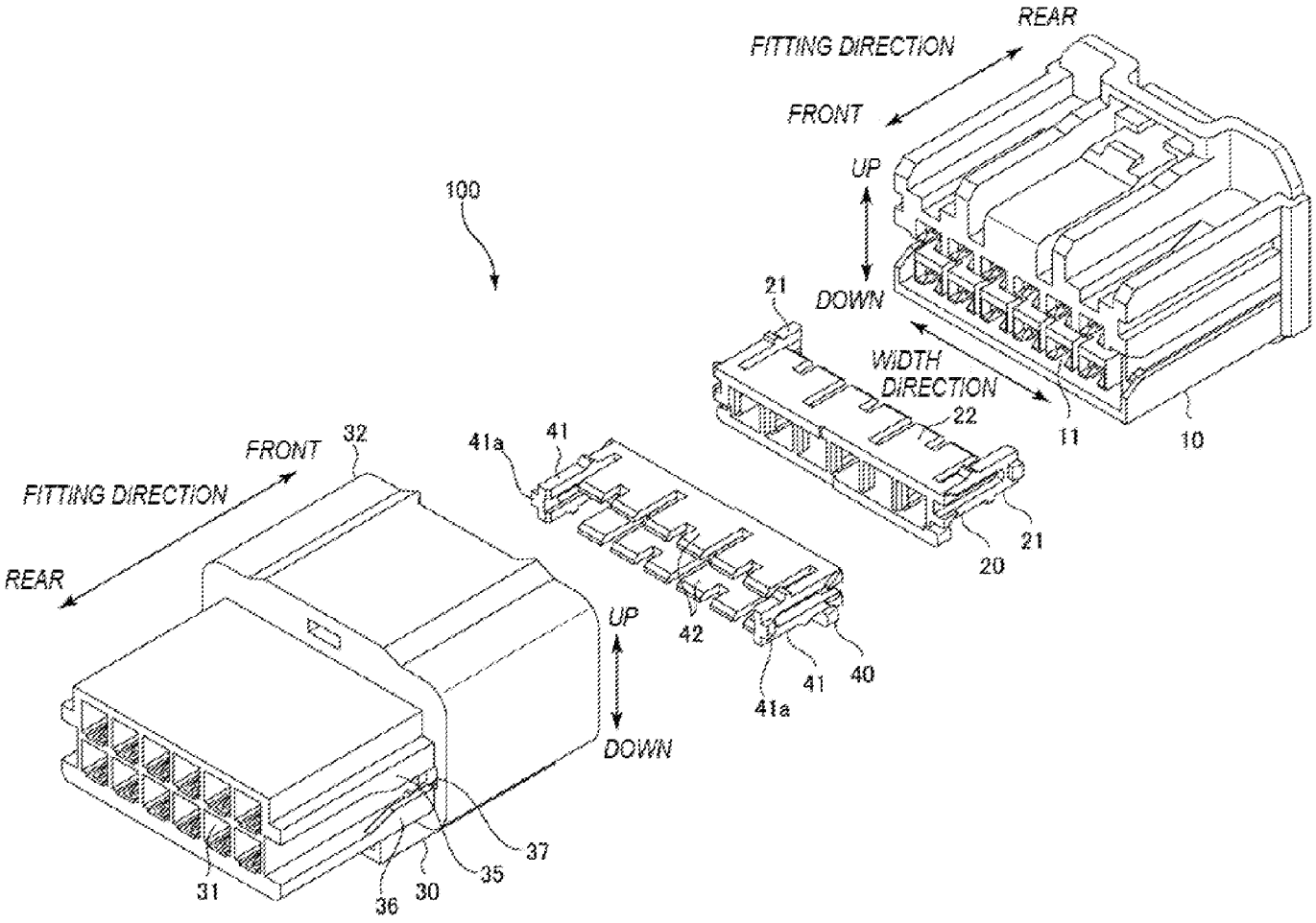
FIG. 1 is a schematic perspective view of a connector according to an embodiment of the invention.

As shown in FIG. 1, a connector 100 according to the embodiment of the invention has a female housing 10, a female-side front holder 20 (hereinafter, simply "front holder"), a male housing 30, and a male-side front holder 40 (hereinafter, simply "front holder"). The "fitting direction", "width direction", "up-down direction", "front", "rear", "up" and "down" are defined as shown in FIG. 1. The "fitting direction", the "width direction" and the "up-down direction" are directions perpendicular to one another.

Inside the female housing 10, a plurality (total of twelve in the embodiment, including six in the width direction and two in the up-down direction) of terminal reception chambers 11 are formed in the fitting direction. In the female housing 10, a plurality (twelve in the embodiment) of female terminals (not shown) connected to end portions of a plurality of electric wires (not shown) respectively are inserted into corresponding ones of the terminal reception chambers 11 respectively from the rear side. After that, the front holder 20 is attached from the front side.

The front holder 20 has a pair of arms 21 and a plurality (12 in the embodiment) of flat-plate-like double locking portions 22. The arms 21 protrude rearward in opposite end portions in the width direction. The double locking portions 22 protrude rearward in positions corresponding to the terminal reception chambers 11 respectively. As will be described later, the pair of arms 21 and the plurality of double locking portions 22 have a function of detecting whether female terminals have been properly received in the terminal reception chambers 11 or not (more specifically, whether the female terminals are in an incompletely inserted state), and a function of more reliably retaining the properly received female terminals.

Inside the male housing 30, a plurality (total of twelve in the embodiment, including six in the width direction and two in the up-down direction) of terminal reception chambers 31 are formed in the fitting direction in the same manner as in the female housing 10. In the male housing 30, a plurality (twelve in the embodiment) of male terminals (not shown) connected to end portions of a plurality of electric wires (not shown) respectively are inserted into corresponding ones of the terminal reception chambers 31 respectively from the rear side. After that, the front holder 40 is attached from the front side. A cylindrical enclosure portion 32 (hood portion) enclosing front end portions (tab portions) of the male terminals is provided integrally on the front side of the male housing 30 for the sake of protection or the like of the front end portions of the male terminals.

The front holder 40 has substantially the same shape as the front holder 20. That is, the front holder 40 has a pair of arms 41 and a plurality (twelve in the embodiment) of flat-plate-like double locking portions 42. The arms 41 protrude rearward in opposite end portions in the width direction. The double locking portions 42 protrude rearward in positions corresponding to the terminal reception chambers 31 respectively. The pair of arms 41 and the plurality of double locking portions 42 have a function of detecting whether male terminals have been properly received in the terminal reception chambers 31 or not (more specifically, whether the male terminals are in an incompletely inserted state), and a function of more reliably retaining the properly received male terminals.

In this manner, the front holder 20 and the front holder 40 have substantially the same shape. Therefore, the front holder 20 can be attached to the male housing 30 in place of the front holder 40. Conversely, the front holder 40 can be attached to the female housing 10 in place of the front holder 20. That is, the front holder 20 and front holder 40 can be shared with each other.

Figure 2A:
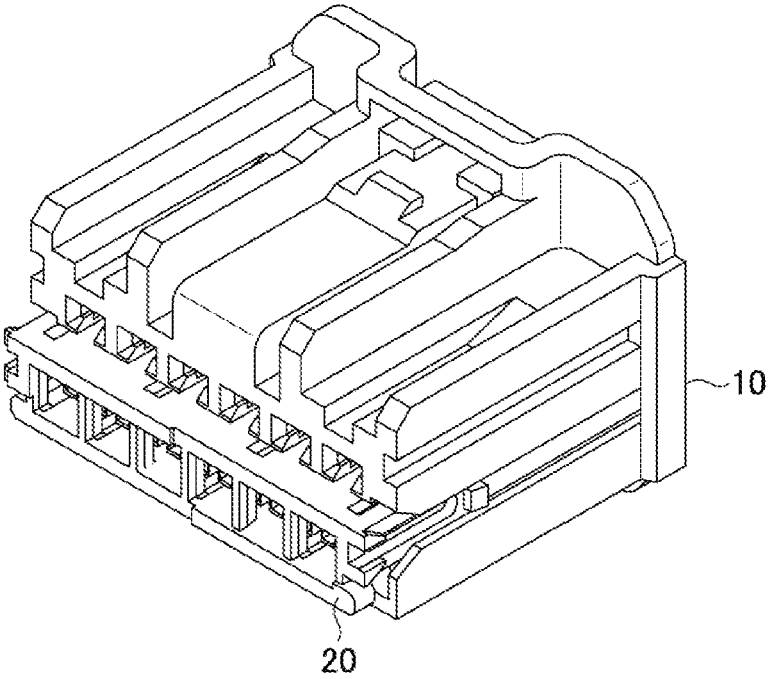
Figure 2B:
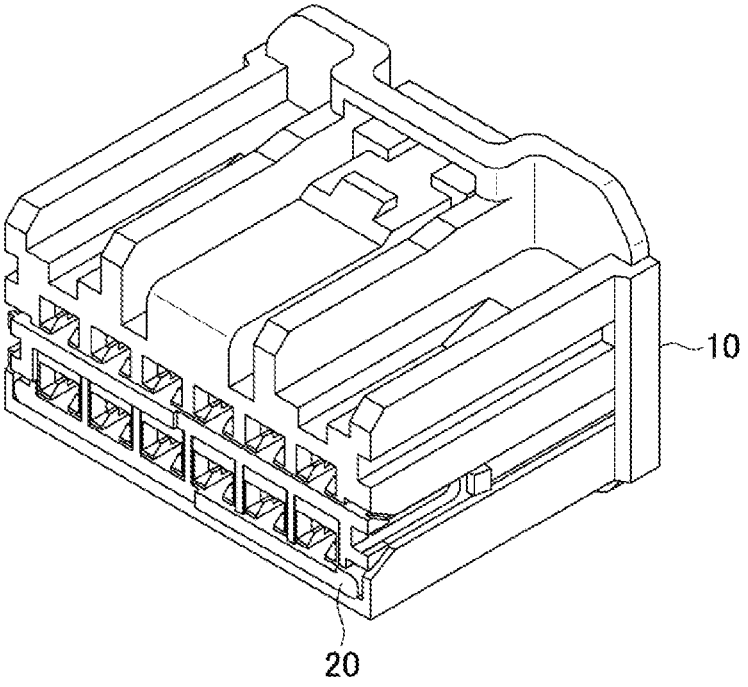

As shown in FIG. 2A and FIG. 2B, the front holder 20 is inserted into the female housing 10 from the front side, and inserted up to a "final" lock position (where the front holder 20 has been completely inserted) shown in FIG. 2B through a "preliminary" lock position (where the front holder 20 has been incompletely inserted) shown in FIG. 2A.

Figure 3:
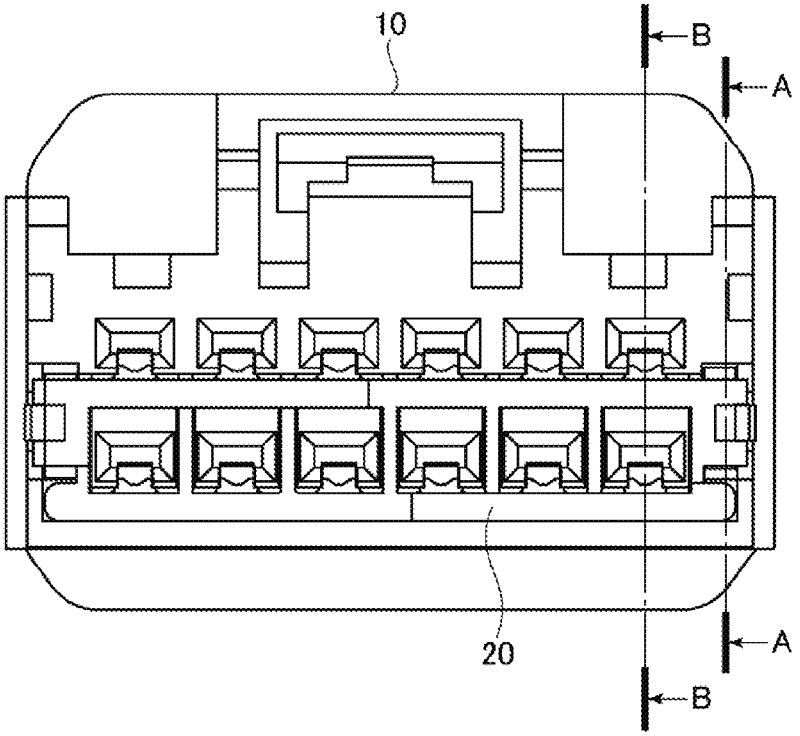
FIG. 3 is a front view of the female housing shown in FIG. 1.
Figure 4A:
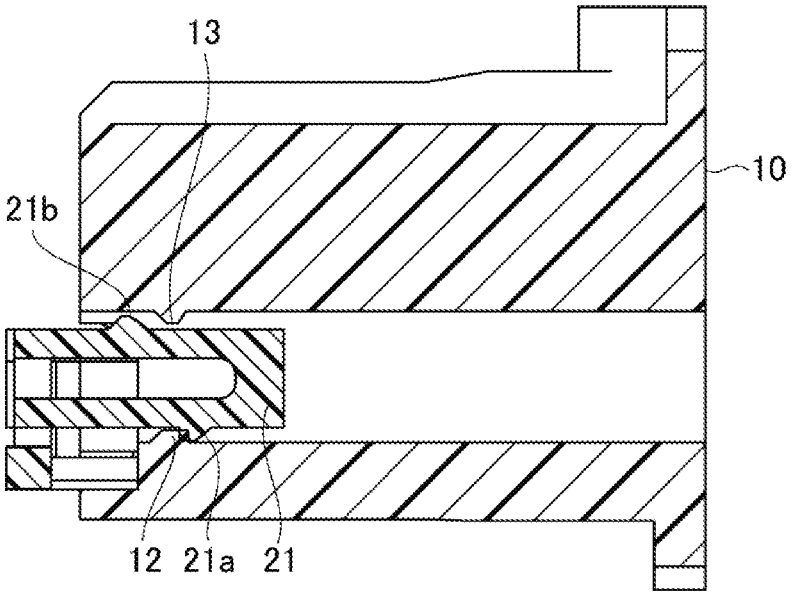

As shown in FIG. 4A (a sectional view taken along the line A-A in FIG. 3), in the state where the front holder 20 is in the "preliminary" lock position shown in FIG. 2A, a protrusion 21*a* (also see FIG. 9) provided in each arm 21 has gotten over a protrusion 12 provided in the female housing 10 while a protrusion 21*b* (also see FIG. 9) provided in the arm 21 has not gotten over a protrusion 13 provided in the female housing 10 yet. Thus, the front holder 20 can be retained in the "preliminary lock position" as long as no external force acts thereon.

Figure 4B:
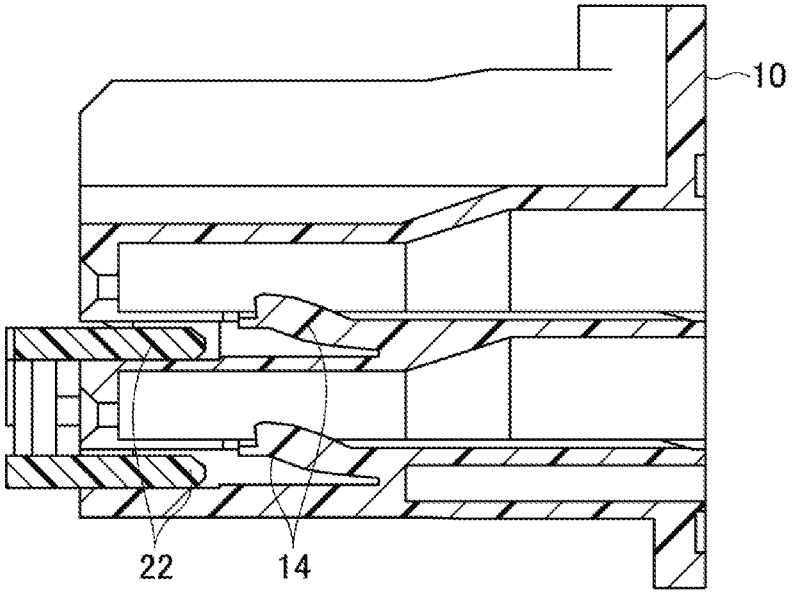

In addition, as shown in FIG. 4B (a sectional view taken along the line B-B in FIG. 3), in the state where the front holder 20 is in the "preliminary" lock position, the double locking portions 22 have not reached lances 14 provided in the female housing 10 yet. The lances 14 are provided correspondingly to the terminal reception chambers 11 respectively.

Each lance 14 is a locking piece extending frontward and obliquely upward. A front end portion of the lance 14 enters the inside of the corresponding terminal reception chamber 11 from an opening portion formed in a lower surface of the terminal reception chamber 11. In a state where a female terminal has been properly received in the terminal reception chamber 11, the front end portion of the lance 14 locks a locking portion of the female terminal received in the terminal reception chamber 11 so that the female terminal can be retained.

On the other hand, in a state where the female terminal has not been properly received in the terminal reception chamber 11 (the incompletely inserted state of the female terminal), the female terminal pushes down the lance 14 so that the lance 14 can be bent to enter a space where the corresponding double locking portion 22 should be inserted. Therefore, the front holder 20 cannot be inserted to the "final" lock position. By use of this, it is possible to detect whether the female terminal is in the incompletely inserted state.

Figure 5A:
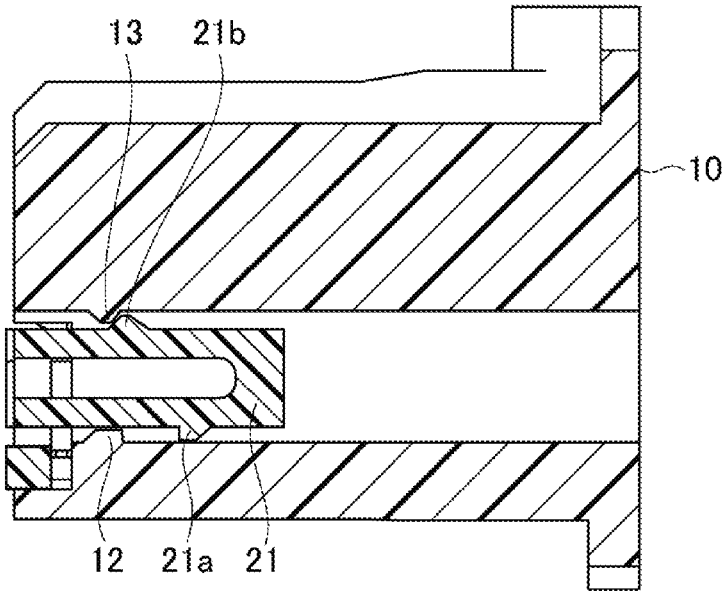
Figure 5B:
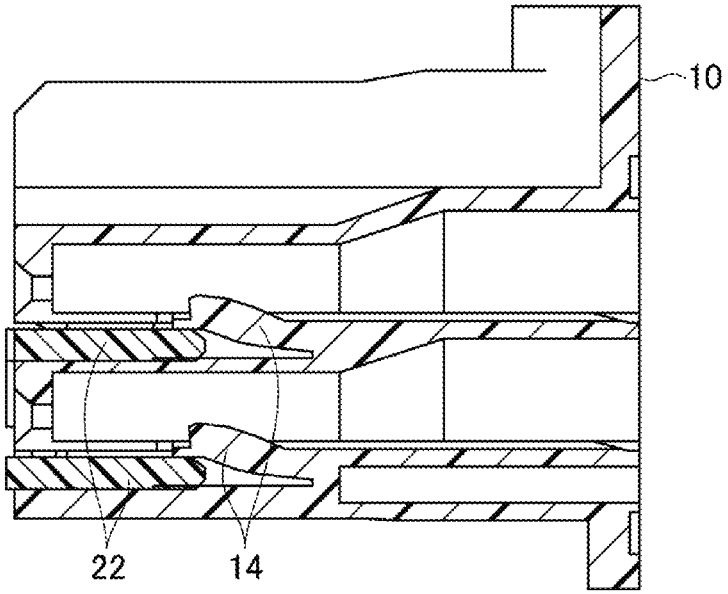

In the state where the front holder 20 is in the "final" lock position shown in FIG. 2B (and in the state where the female terminal has been properly received in the terminal reception chamber 11), the protrusion 21*b* has gotten over the protrusion 13 as shown in FIG. 5A (a sectional view taken along the line A-A in FIG. 3). In addition, as shown in FIG. 5B (a sectional view taken along the line B-B in FIG. 3), the double locking portion 22 enters the space under the lance 14 so as to push the lance 14 toward the female terminal (upward). Thus, it is possible to obtain a so-called double locking state in which the lance 14 locks the female terminal and the double locking portion 22 locks the lance 14 (in a normal position where the retaining function can be obtained). Due to the double locking state, the female terminal properly received in the terminal reception portion 11 can be more reliably retained.

In this manner, in the state where the front holder 20 is in the "final" lock position, the front holder 20 can be retained in the "final" lock position as long as no external force acts thereon.

In the same manner as the front holder 20, the front holder 40 is, though not shown, also inserted into the male housing 30 from the front side, and inserted up to a "final" lock position (at which the front holder 40 is completely inserted) via a "preliminary" lock position (at which the front holder 40 is in an incompletely inserted state).

Figure 6:
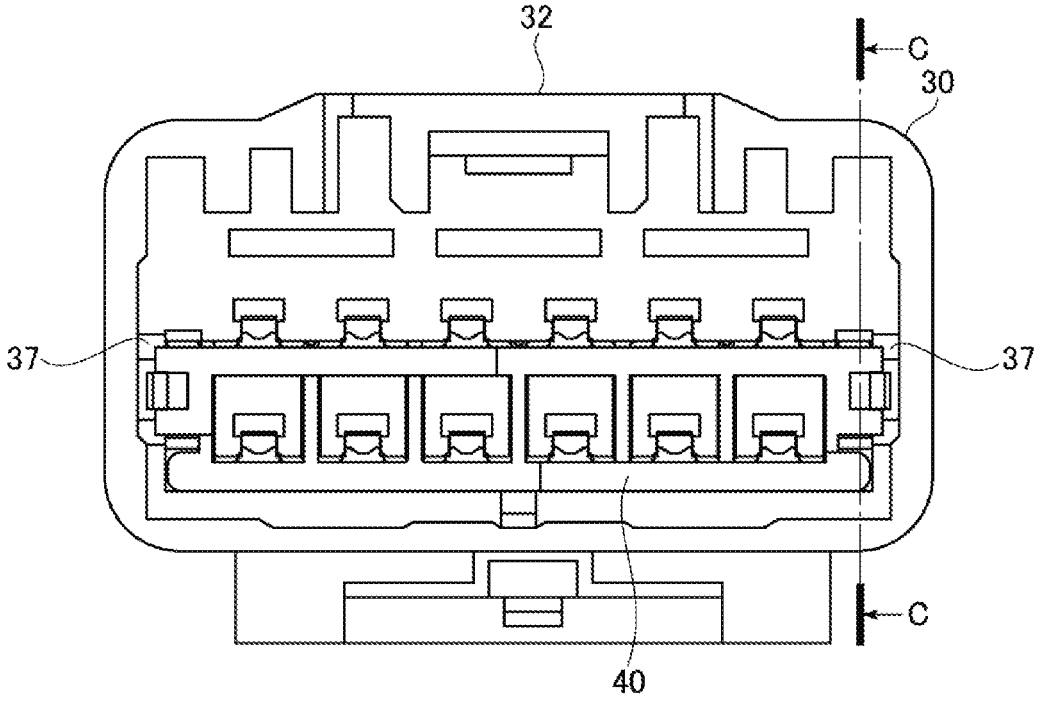
FIG. 6 is a front view of a male housing shown in FIG. 1.
Figure 7A:
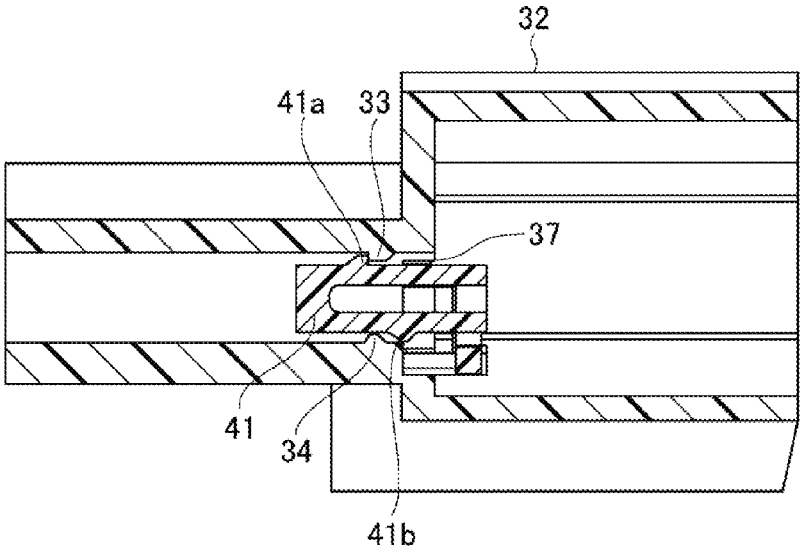
FIG. 7A is a sectional view taken along the line C-C in FIG. 6 with a male-side front holder being incompletely inserted.

In the state where the front holder 40 is in the "preliminary" lock position, as shown in FIG. 7A (a sectional view taken along the line C-C in FIG. 6), a protrusion 41*a* provided in each arm 41 has gotten over a protrusion 33 provided in the male housing 30 while a protrusion 41*b* provided in the arm 41 has not gotten over a protrusion 34 provided in the male housing 30 yet. Thus, the front holder 40 can be retained in the "preliminary lock position as long as no external force acts thereon. In addition, though not shown, each double locking portion 42 has not reached a position of a corresponding lance provided in the male housing 30.

Figure 7B:
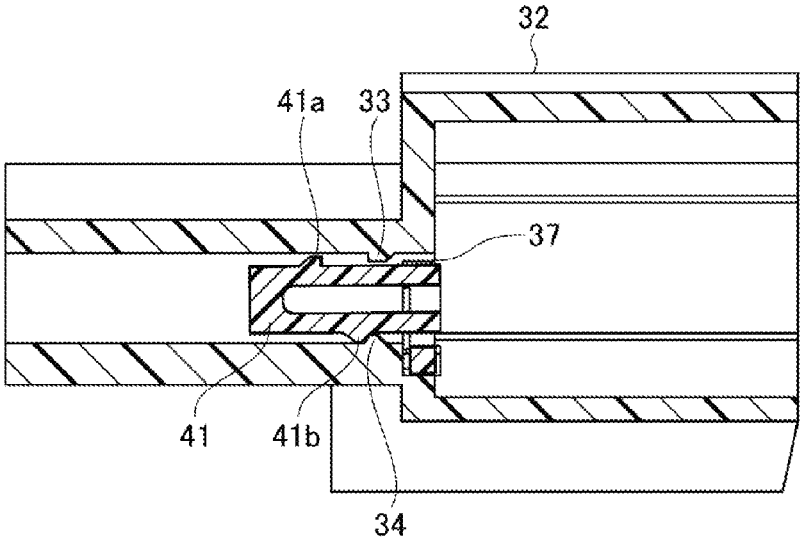
FIG. 7B is a sectional view taken along the line C-C in FIG. 6 with the male-side front holder being completely inserted.

On the other hand, in the state where the front holder 40 is in the "final" lock position (and in the state where the male terminal has been properly received in the terminal reception chamber 31), the protrusion 41*b* has gotten over the protrusion 34 as shown in FIG. 7B (a sectional view taken along the line C-C in FIG. 6). In addition, though not shown, each double locking portion 42 enters a space under a corresponding lance to push the lance toward the male terminal (upward). Thus, the front holder 40 can be retained in the "final" lock position as long as no external force acts thereon.

In the same manner as in the case of the lance 14 provided in the female housing 10 and the double locking portion 22 of the front holder 20, whether the male terminal is in an incompletely inserted state can be detected by the cooperation between the lance provided in the male housing 30 and the double locking portion 42 of the front holder 40. In addition, due to the double locking state, the male terminal properly received in the terminal reception chamber 31 can be retained more reliably.

Figure 8A:
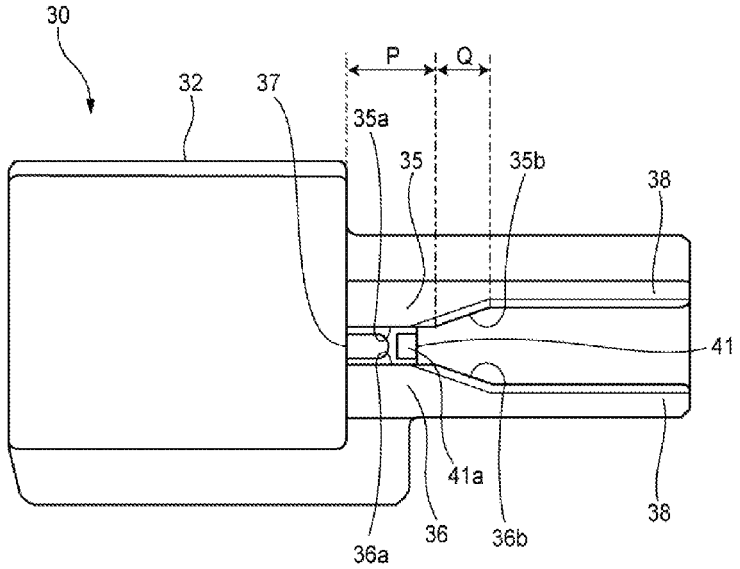
FIG. 8A is a side view with the male-side front holder being incompletely inserted.
Figure 8B:
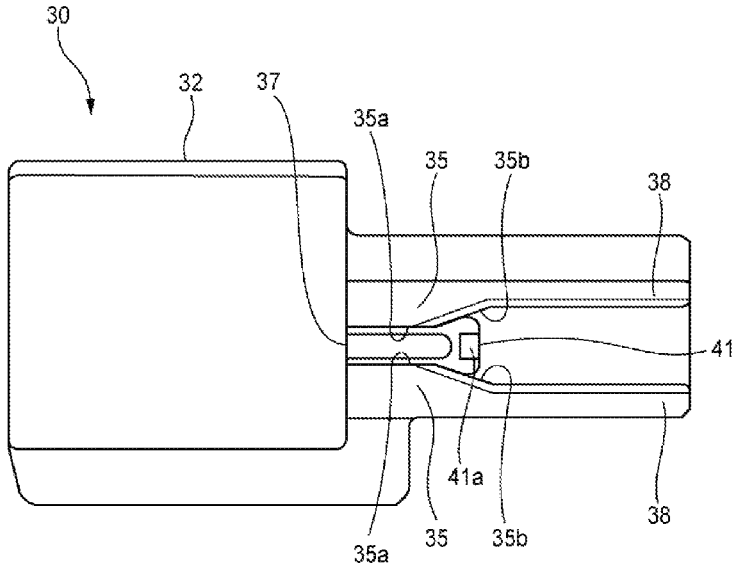
FIG. 8B is a side view with the male-side front holder being completely inserted.

On the other hand, as shown in FIG. 8A and FIG. 8B, a pair of covers 35, 36 are formed in each side surface of the male housing 30 so as to cover the corresponding arm 41 of the front holder 40. The cover 35 is an extension wall formed on the side surface of the male housing 30, and the cover 36 is an extension wall formed on the side surface of the male housing 30. The covers 35, 36 extend so that extension ends (35*a*, 35*b*, 36*a*, 36*b*) of the covers 35, 36 can approach each other to cover the arm 41.

The covers 35, 36 have a shape in which a first part P and a second part Q are contiguous with each other. In the first part P, the distance between the extension end 35*a* and the extension end 36*a* is constant irrespective of a location in the attaching direction of the front holder 40 (the right direction in FIGS. 8A and 8B). In the second part Q, the distance between the extension end 35*b* and the extension end 36*b* increases gradually they extend away from the first part P in the attaching direction of the front holder 40 (the right direction in FIGS. 8A and 8B).

When attaching the front holder 40 to the male housing 30, the arm 41 of the front holder is inserted into a through hole 37 formed in a rear wall surface of the enclosure portion 32 of the male housing 30 in the fitting direction as shown in FIG. 6. Thus, the arm 41 enters a region surrounded by the covers 35, 36 as shown in FIG. 8A and FIG. 8B. More specifically, when the front holder 40 is in the preliminary lock position, the front end of the arm 41 is in a position corresponding to the first part P as shown in FIG. 8A. When the front holder 40 then moves from the preliminary lock position to the final lock position, the front end of the arm 41 moves to a position corresponding to the second part Q. Also in the opposite side surface of the male housing 30 to the side surface shown in FIG. 8A and FIG. 8B, the other arm 41 inserted into a through hole 37 (see FIG. 6) is covered with a pair of covers (not shown) in the same manner as described above.

As described above, when the front holder 40 moves from the preliminary lock position to the final lock position, the protrusion 41*a* provided in the front end of the arm 41 passes through a space between the extension ends 35*a*, 35*b*, 36*a*, 36*b* of the pair of covers 35, 36. Thus, during the movement, an external force required for the movement can be applied to the front holder 40 through the protrusion 41*a*.

Further, a pair of ridge portions 38 formed to extend in the attaching direction of the front holder 40 are formed in each side surface of the male housing 30. The distance between the pair of ridge portions 38 is constant irrespective of a location in the attaching direction of the front holder 40. Further, the pair of ridge portions 38 are formed to be connected to the pair of covers 35, 36 in the second part Q. The ridge portions 38 have a function of guiding a finger of the user or the like to the front end of the arm 41 when the user removes the front holder 40 from the male housing 30 intentionally.

In this manner, the arm 41 of the front holder 40 is covered with the covers 35, 36 so that a major part of the arm 41 can be covered with the covers 35, 36. Therefore, the possibility that a hand of the user or the like may touch the arm 41 unintentionally is low. On the other hand, on this occasion, the front end of the arm 41 is in the second part Q (which is a part where the distance between the covers 35, 36 increases gradually), the user can operate the arm 41 easily when the user removes the front holder 40 from the male housing 30 (cancels the double locking state) intentionally. It is therefore easy to intentionally cancel the double locking state in the front holder 40. Thus, both protection of the arm 41 assisting the attachment and the like of the front holder 40 and easiness of the intentional unlocking of the double-locking by the front holder can be achieved.

Next, description will be made about simplifying the attachment of the front holder 40 to the male housing 30 and the removal of the front holder 40 from the male housing 30.

Figure 9:
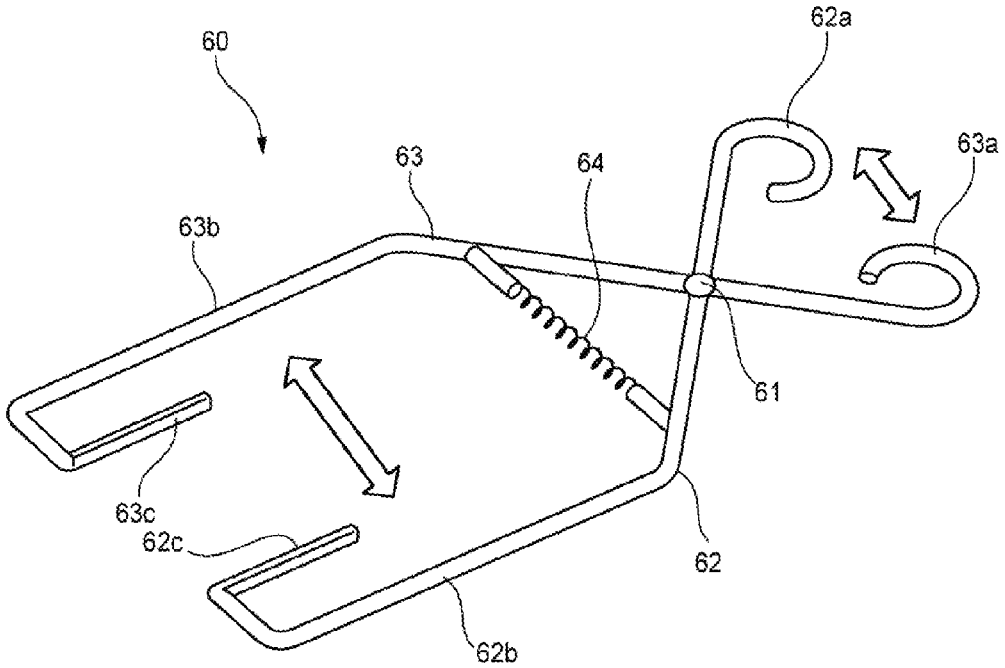
FIG. 9 is a perspective view of a jig for use in a work of attaching the front holder to the male housing or in a work of removing the front holder from the male housing.

As described above, an external force is applied to the front end (or the protrusion 41*a*) of each arm 41 by a finger of the user or the like so that the front holder 40 can be attached to the male housing 30 easily and the front holder 40 can be removed from the male housing 30 easily. However, those works may be performed using a special jig 60 as shown in FIG. 9.

Specifically, the jig 60 has a pair of rod-like bodies 62, 63 connected rotatably around a hinge 61. The rod-like bodies 62, 63 include gripping portions 62*a*, 63*a*, intermediate portions 62*b*, 63*b*, contact portions 62*c*, 63*c*, and a spring 64. The gripping portions 62*a*, 63*a* are gripped by fingers of the user or the like. A force applied to the gripping portions 62*a*, 63*a* is transmitted through the intermediate portions 62*b*, 63*b*. The contact portions 62*c*, 63*c* come in contact with the front holder 40. One end of the spring 64 is connected to the rod-like body 62, and the other end of the spring 64 is connected to the rod-like body 63. The jig 60 has a scissors-like shape as a whole. When an external force is applied by the jig 60 so that the gripping portions 62*a*, 63*a* can approach each other, the distance between the contact portions 62*c*, 63*c* can be reduced. The spring 64 generates drag against the external force to make it easy to open and close the contact portions 62*c*, 63*c*.

Figure 10:
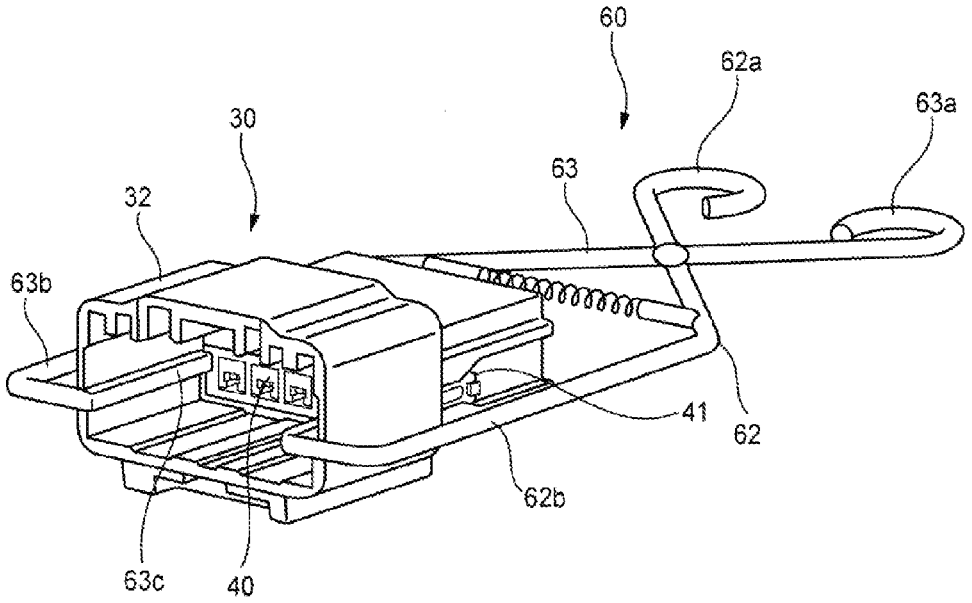
FIG. 10 is a perspective view illustrating a state in which the front holder is being attached to the male housing using the jig shown in FIG. 9.

As shown in FIG. 10, when attaching the front holder 40 to the male housing 30, the arms 41 of the front holder 40 are inserted into the through holes 37 (see FIG. 6) formed in the enclosure portion 32 of the male housing 30. After that, the jig 60 is disposed so that the contact portions 62*c*, 63*c* of the jig 60 can abut against the front holder 40. Then, when the jig 60 is moved in the attaching direction of the front holder 40 (on the deeper side of the paper of FIG. 10), the front holder 40 can be attached to the male housing 30.

Figure 11:
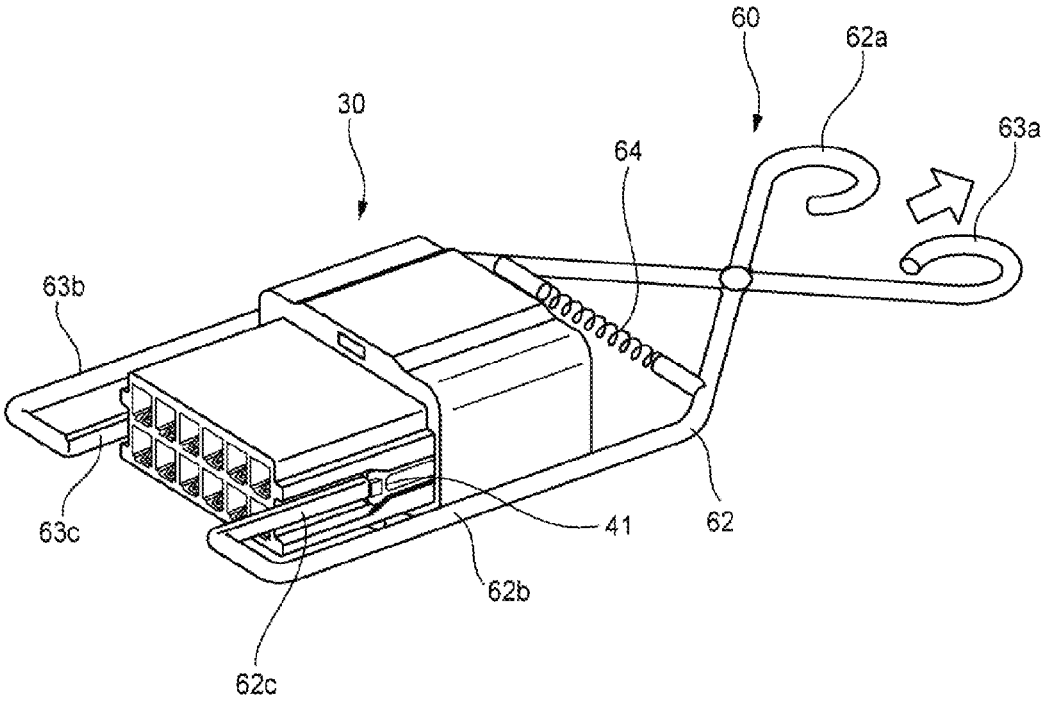
FIG. 11 is a perspective view illustrating a state in which the front holder is being removed from the male housing using the jig shown in FIG. 9.

On the contrary, as shown in FIG. 11, when the front holder 40 is removed from the male housing 30, the jig 60 is disposed so that the contact portions 62*c*, 63*c* of the jig 60 can abut against the front ends of the arms 41 of the front holder 40 located in the final lock position. After that, when the jig 60 is moved in a direction in which the front holder 40 can be removed (on the deeper side of the paper of FIG. 11), the front holder 40 can be removed from the male housing 30.

As described above, with the connector 100 according to the embodiment of the invention, the front end of each arm 41 is in a position corresponding to the first part P of the pair of covers 35, 36 (the part where the extension ends 35*a*, 36*a* are parallel to each other) when the front holder 40 is in the preliminary lock position. When the front holder 40 is in the final lock position, the front end of the arm 41 is in a position corresponding to the second part Q of the pair of covers 35, 36 (the part where the distance between the extension ends 35*b*, 36*b* increases gradually). That is, when attaching the front holder 40 to the male housing 30 (in the final lock position), a major part of the arm 41 is covered with the pair of covers 35, 36. Therefore, a user's hand, a peripheral member or the like is less likely to touch the arm 41 unintentionally than in the aforementioned related art connector. On the other hand, in this state, the front end of the arm 41 is located in the part (the second part Q) where the distance between the pair of covers 35, 36 increases gradually. Therefore, when the user removes the front holder 40 from the male housing 30 intentionally (unlocks the double-locked state), the user can operate the arm 41 easily (apply an external force to the front end of the arm 41 easily). It is therefore easy to intentionally unlock the double locking state in the front holder 40.

Thus, with the connector 100 according to the embodiment of the invention, both the protection of the arm 41 that assists the attachment and the like of the front holder 40 and the easiness of the intentional unlocking of the double-locking by the front holder can be achieved as much as possible.

Further, according to the connector 100, the pair of ridge portions 38 have a function of guiding the user's finger or the like to the front end of the arm 41 when the user removes the front holder 40 from the male housing 30 intentionally. Therefore, the user can operate the arm 41 more easily. Thus, according to the connector 100, it is easier to intentionally unlock the double locking state by the front holder 40.

Further, according to the connector 100, in a step of moving the front holder 40 toward the final lock position via the preliminary lock position (or in a step of moving the front holder 40 in the opposite direction thereto), at least the protrusion 41*a* at the front end of the arm 41 is exposed to the outside. Therefore, in the aforementioned step, an external force can be applied to the front holder 40 through the protrusion 41*a*. Thus, according to the connector 100, the above step (e.g., intentional unlocking of the double locking state by the front holder 40) can be performed more easily than in a case where there is no protrusion 41*a*.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

According to one or more exemplary embodiments of the present invention, a connector (100) includes a housing (30) having a terminal reception chamber (31) in which a terminal is received, and a front holder (40) attached to the housing such that the front holder (40) is moved toward a final lock position via a preliminary lock position to double-lock the terminal in the terminal reception chamber (31). The front holder (40) includes an arm portion (41) extending in an attaching direction of the front holder (40), at least a part of the arm portion (41) being exposed at a side surface of the housing (30) when the front holder (40) is attached to the housing (30). The housing (30) includes a pair of extension walls (35, 36) formed on the side surface of the housing (30) and extending such that extension ends (35*a*, 35*b*, 36*a*, 36*b*) of the pair of extension walls (35, 36) approach each other to cover the arm portion (41). The pair of extension walls (35, 36) has a shape in which a first part (P) and a second part (Q) are contiguous with each other, a distance between the extension ends (35*a*, 35*b*, 36*a*, 36*b*) of the extension walls (35, 36) being constant irrespective of a location in the attaching direction in the first part (P), the distance increases gradually in the second part (Q) as they extend away from the first part (P) in the attaching direction. A distal end of the arm portion (41) is in a position corresponding to the second part (Q) when the front holder (40) is in the final lock position, and the distal end of the arm portion (41) is in a position corresponding to the first part (P) when the front holder (40) is in the preliminary lock position.

The connector may further include a pair of ridge portions (38) extending in the attaching direction on the side surface of the housing (30), a distance between the pair of ridge portions being constant irrespective of a location in the attaching direction. The pair of ridge portions (38) are connected to the pair of extension walls (35, 36) in the second part (Q).

The front holder (40) may include a protrusion (41*a*) at the distal end of the arm portion (41), the protrusion (41*a*) protruding in a direction away from the side surface of the housing (30). When the front holder (40) is moved toward the final lock position via the preliminary lock position to attach the front holder (40) to the housing (30), the protrusion (41*a*) passes through a space between the extension ends (35*a*, 35*b*, 36*a*, 36*b*) of the extension walls (35, 36).

What is claimed is:

1. An electrical connector comprising:

a housing having a terminal reception chamber in which a terminal is received; and a front holder attached to the housing such that the front holder is moved toward a final lock position via a preliminary lock position to double-lock the terminal in the terminal reception chamber, wherein the front holder comprises an arm portion extending in an attaching direction of the front holder, at least a part of the arm portion being exposed at a side surface of the housing when the front holder is attached to the housing;

wherein the housing comprises a pair of extension walls formed on the side surface of the housing and extending such that extension ends of the pair of extension walls approach each other to cover the arm portion;

wherein the pair of extension walls has a shape in which a first part and a second part are contiguous with each other, a distance between the extension ends of the extension walls being constant irrespective of a location in the attaching direction in the first part, and the distance increases gradually in the second part as the extension ends extend away from the first part in the attaching direction;

wherein a distal end of the arm portion is in a position corresponding to the second part when the front holder is in the final lock position, and the distal end of the arm portion is in a position corresponding to the first part when the front holder is in the preliminary lock position;

wherein the front holder comprises a protrusion at a center of the distal end of the arm portion, the protrusion protruding in a direction away from the side surface of the housing, and wherein, when the front holder is moved toward the final lock position via the preliminary lock position to attach the front holder to the housing, the protrusion passes through a space between the extension ends of the extension walls.

2. The electrical connector according to claim 1, further comprising a pair of ridge portions extending in the attaching direction on the side surface of the housing, a distance between the pair of ridge portions being constant irrespective of a location in the attaching direction, wherein the pair of ridge portions are connected to the pair of extension walls in the second part.

* * * * *